United States Patent [19]

Petretti

[11] Patent Number: 4,543,183

[45] Date of Patent: Sep. 24, 1985

[54] EDUCTOR TRUCK

[75] Inventor: Anthony V. Petretti, Whitestone, N.Y.

[73] Assignee: Metro Hoist & Body Co., Inc., Whitestone, N.Y.

[21] Appl. No.: 576,751

[22] Filed: Feb. 3, 1984

[51] Int. Cl.[4] ..... B01D 21/00; C02C 1/18

[52] U.S. Cl. ..... 210/187; 210/241

[58] Field of Search ..... 210/232, 241, 257.1, 210/181, 182, 187, 149

[56] References Cited

U.S. PATENT DOCUMENTS

| | | | |
|---|---|---|---|
| 1,345,531 | 7/1920 | Cartright | 210/241 |
| 2,792,117 | 5/1957 | Laboon | 210/187 |
| 3,317,049 | 5/1967 | Petretti | 210/241 |
| 3,394,813 | 7/1968 | Phillips et al. | 210/149 |
| 3,586,170 | 6/1971 | Reid | 210/181 |
| 4,153,553 | 5/1979 | Davis | 210/187 |

*Primary Examiner*—John Adee

*Attorney, Agent, or Firm*—Stoll, Wilkie, Previto & Hoffman

[57] ABSTRACT

An eductor truck for removing debris from catch basins which is provided with adequate storage facilities, improved safety features and improved door opening features, and improved tank heating features.

14 Claims, 12 Drawing Figures

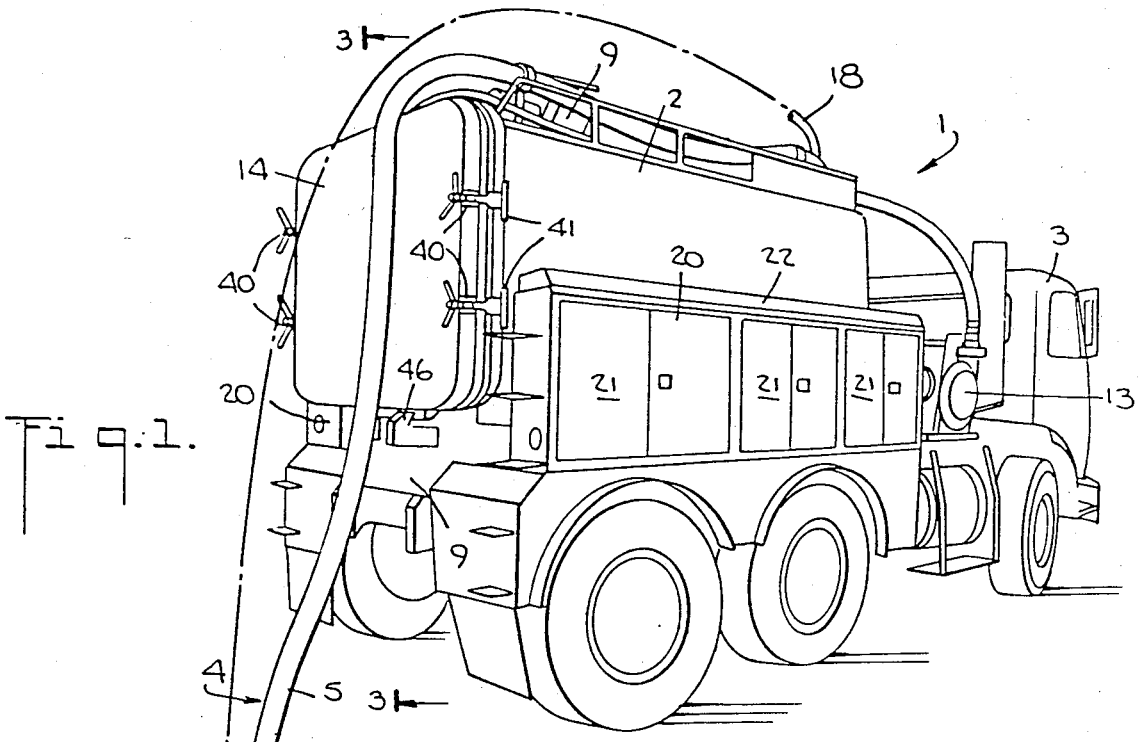
Fig. 1.
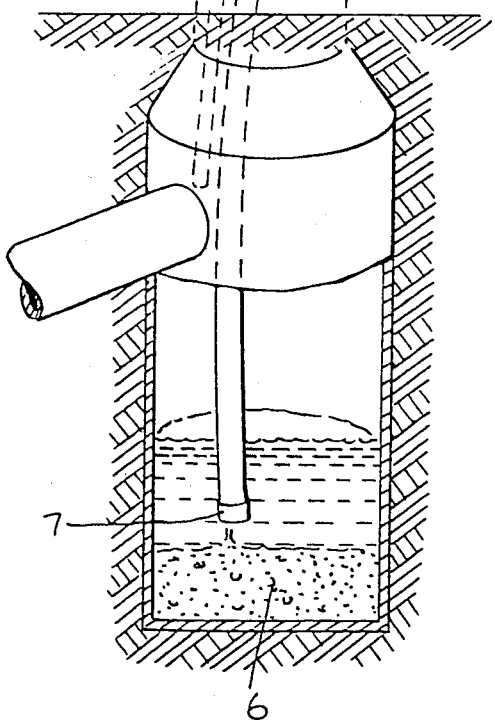
Fig. 4.
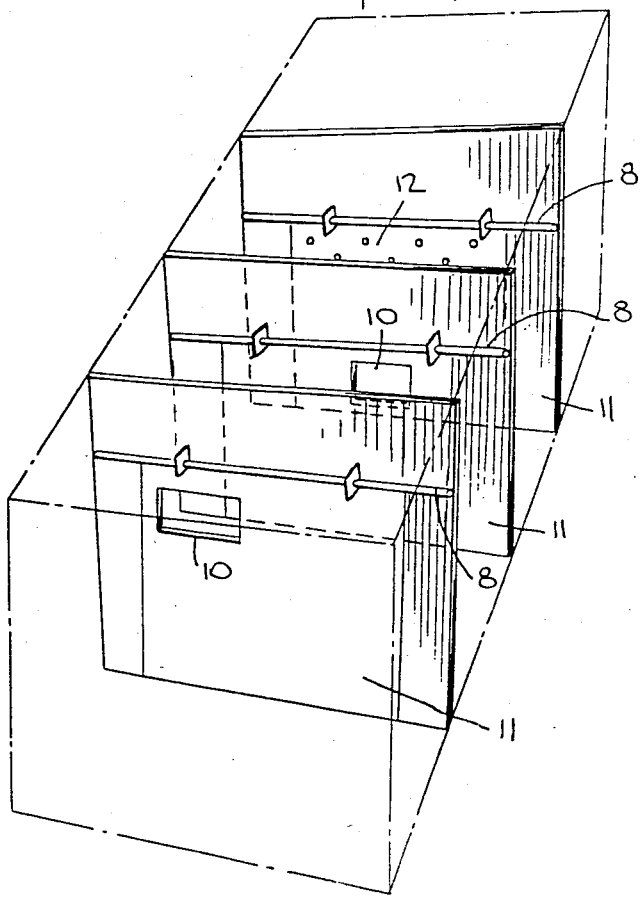

EDUCTOR TRUCK

RELATED APPLICATION

This application is a continuation-in-part of pending U.S. patent application Ser. No. 478,356 filed Mar. 24, 1983 (now U.S. Pat. No. 4,436,622) which, in turn, is a division of U.S. patent application Ser. No. 40,551 filed May 21, 1979 (now U.S. Pat. No. 4,389,314).

DESCRIPTION

The present invention is directed to a flush tank eductor truck and more particularly to a flush tank eductor truck which is adapted to siphon debris, etc. from catch basins, to store the debris within its settling tank and to thereafter dump the debris into a suitable dump area.

Eductor trucks are used to siphon debris which may be mixed with a fluid, such as water, from sewers, catch basins, etc. and to deposit the mixture of fluid and debris into a suitable settling tank, preferably mounted on the truck which is then transported to a suitable dump and disposed of.

In cases where the debris is substantially dry, the eduction unit deposits a fluid into the sewer or catch basin in order to loosen the debris and to mix it with the fluid so that it will be easily siphoned-off by the eduction unit. The mixture is deposited in the settling tank where the heavier debris falls to the floor. The fluid with the lighter debris in suspension passes through a series of baffles and/or strainers so that the lighter debris is removed from the fluid. The fluid (which is now relatively free of debris) is re-deposited into the catch basin and re-used to loosen and mix with additional debris.

In such eductor trucks, there has been a scarcity of space for tools, equipment, hoses and other materials necessary for effective operation. In addition, it has been difficult to insure that the settling tank remains suspended when it is raised during maintenance. Furthermore, it has been awkward for the eduction unit to be operated by the operator without climbing up to the top of the truck. In addition, the means for opening the settling tank to permit dumping has been difficult and awkward.

In existing tank-type eductor trucks, a freezing problem has been encountered. Since the contents of the tanks of such eductor units consist primarily of water, the water tends to freeze in sub-freezing temperatures which makes it difficult for the contents to be dumped and also makes it difficult for the contents to be drawn into the tank.

Furthermore, it has also been found that existing trucks have high noise levels since the power for controlling the eduction unit is primarily derived from an auxiliary motor on the truck.

The present invention avoids these difficulties and has for one of its objects the provision of an improved eductor truck which has means to hold the rear door closed until it is to be opened.

Another object of the present invention is the provision of an improved eductor truck which has means to permit storage of tools, etc. without interfering with the operation of the settling tank.

Another object of the present invention is the provision of an improved eductor truck which has improved safety features for holding the settling tank in its raised position during maintenance operation.

Another object of the present invention is the provision of an improved eductor truck which has improved means for automatically operating the eductor unit.

Another object of the present invention is the provision of an improved eductor truck which has means for heating the tank of the truck to prevent freezing.

Another object of the present invention is the provision of an improved eductor truck which is provided with heating means for the tank without the use of separate heating mechanisms.

Another object of the present invention is the provision of an improved eductor truck in which the eduction operation is powered from the truck's transmission in order to improve energy, efficiency and reduce truck noises.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 1 is a perspective view of a truck having an eduction unit embodying the present invention.

FIG. 4 is a perspective fragmentary view of the interior of the settling tank.

Figure 3:
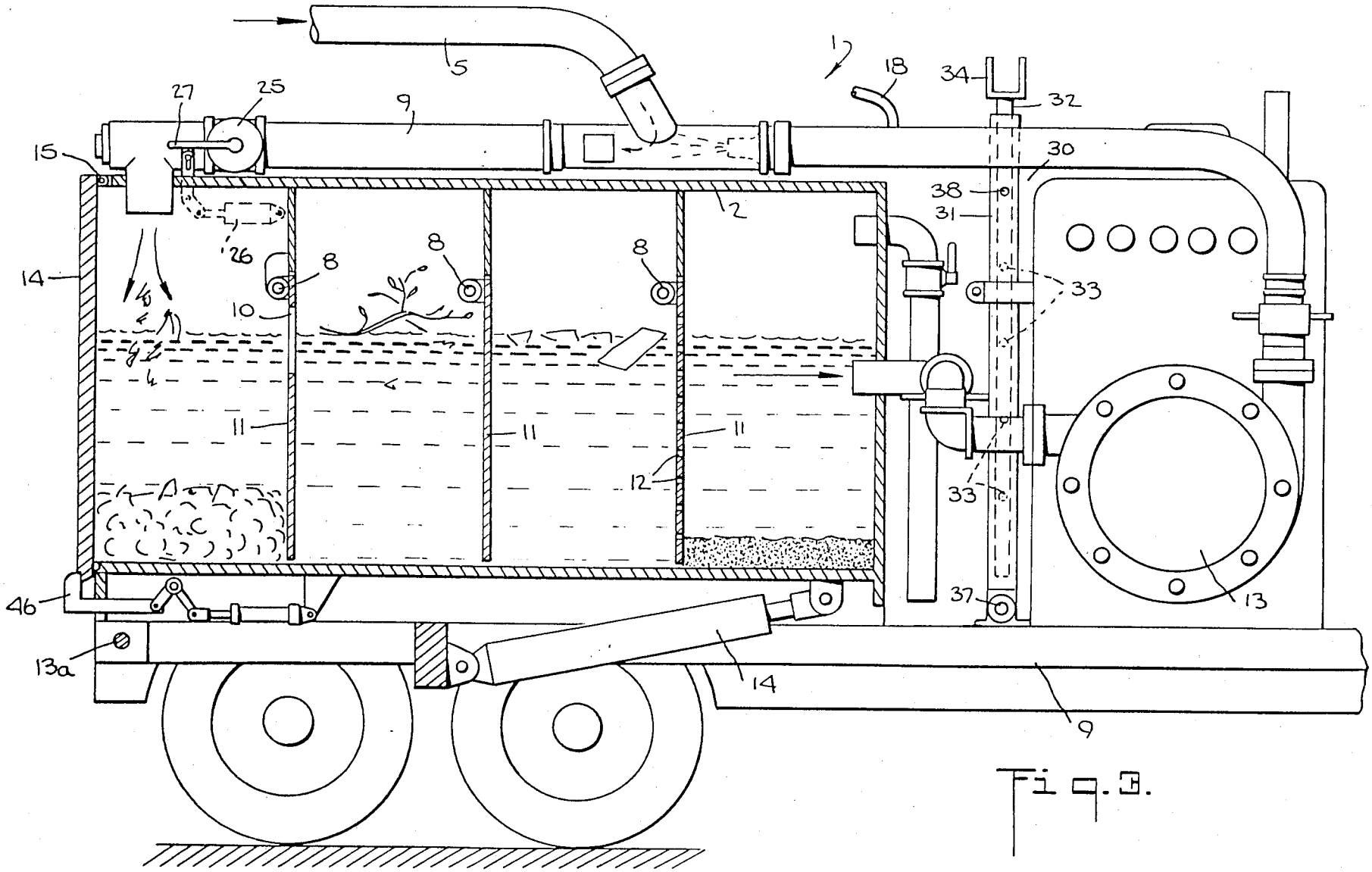
FIG. 3 is a sectional view taken along line 3—3 of FIG. 1.

Referring to the drawings and more particularly to FIG. 1, a truck 1, usually called an eductor truck because it includes an eduction unit 4, comprises a settling tank 2, a front cab 3 and rear frame 9. The truck 1 is provided with the usual eduction mechanism, generally designed by the reference numeral 4. The eduction mechanism 4 comprises a suction pipe 5 having a nozzle 7 mounted on its lower end which is adapted to siphon a fluid, such as water, from a catch basin 6. The hose 5 is adapted to remove the mixture of debris and fluid from the catch basin 6 and to deposit it into the settling tank 2 through a discharge pipe 9 (FIG. 3). A smaller spray hose 18 is provided to permit the user to loosen debris in the basin 6.

The settling tank 2 is also provided with one or more interior baffle plates 11. Each baffle plate 11 (FIGS. 3 and 4) is mounted to swing on a pivot 8 and has one or more openings 10 therein. With this structure, the heavier debris will fall to the bottom of settling tank 2 and the lighter debris in suspension will be carried by the fluid through the openings 10. The openings 10 may be staggered and may be adjusted by slidable doors (not shown) to regulate the flow of the fluid therethrough.

A strainer unit 12 is provided on a forward baffle 11 to remove the lighter debris from the fluid before the fluid is passed through pump 13 (operated by auxiliary motor 130—see FIG. 7) to the pressure pipe 5 to be re-used.

With this structure, the mixture of debris and fluid is deposited at the rear of the settling tank 2 and passes forwardly through baffles 11 and strainer 12. The heavy debris drops to the bottom of the tank 2 and the lighter debris in suspension passes through the openings 10 in baffles 11 and the openings in the strainer 12. The strainer 12 will filter the finer debris from the fluid and permit the fluid to pass through.

When the settling tank 2 is to be cleaned out, the tank 2 is pivoted and lifted upwardly around pivot 13 by a hydraulic cylinder 14 located therebeneath. The rear door 14 swings open around upper pivot 15 and the baffles 11 swing open on pivots 8 to permit the debris to be cleaned out.

As shown in the drawings, the settling tank 2 is positioned between a pair of storage cabinet units 20 located on each side thereof. The cabinet units 20 may have suitable doors 21 to permit access thereto to permit tools, extra hoses and other equipment to be stored in the cabinets 20. Since the settling tank 2 is positioned between the two cabinet units 20, the operation and lifting of the tank 2 will not be interferred with. The top of the storage cabinets 20 may have a walkway 22 which will permit the operator to climb up to the top of the settling tank, if necessary.

An eductor unit control valve 25 (FIG. 3) is positioned near the rear end of the top of the settling tank to control operation of the eductor unit. This valve 25 is controlled by a hydraulic cylinder 26 mounted along the side of the settling tank 2 with its control arm 27 attached to the piston of cylinder 26. The hydraulic cylinder 26 is controlled by any known remote means (not shown) by the operator of the truck. Hence, the operation of the eduction unit is operated remotely without the necessity of the operator climbing to the top of the settling tank 2 to operate the valve 25.

Figure 2:
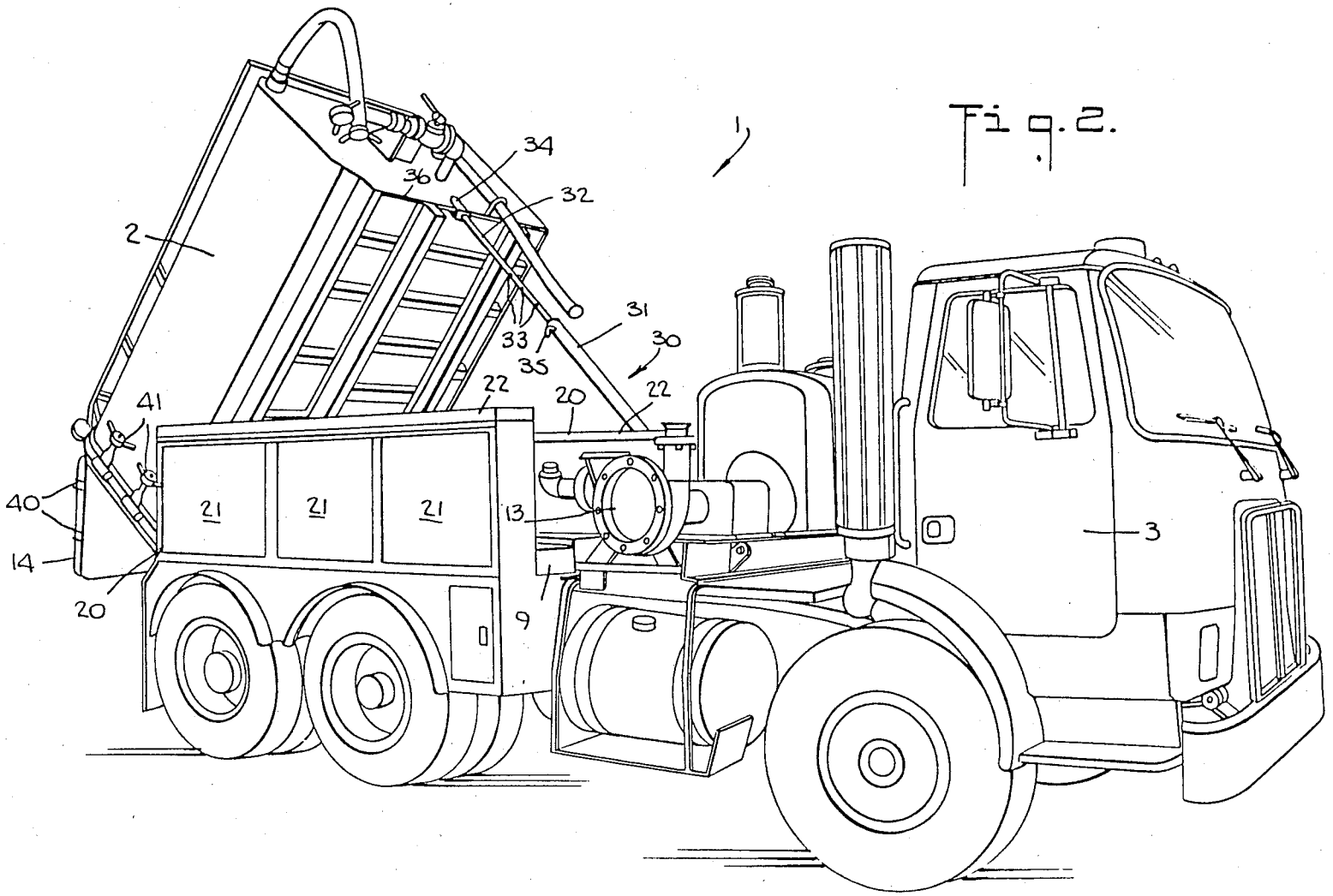
FIG. 2 is a perspective view showing the truck with the settling tank in a raised position.

When the settling tank 2 is raised, especially for maintenance purposes, a safety holding arm mechanism 30 is used to insure that the tank 2 will not drop should there be a failure in the hydraulic device 14. This safety arm 30 comprises an outer lower tube 31 pivotally mounted to the frame 9 at 37. An extendable rod 32 is telescopically mounted within the tube 31 and is provided with a holding fork 34 at its upper end. A series of openings 33 are provided in the arm 32 and an opening 38 is provided in tube 34 so that a pin 35 (FIG. 2) may be inserted through opening 38 into a selected opening 33 to hold the arm in its raised position. After the fork 34 is inserted beneath an edge 36 of the settling tank 2 it is held in place by pin 35 extending through openings 38 and 33 to support the tank in its upright position.

In order to open the rear door 14 of the tank 2, a plurality of fastening devices 40 in the form of lag screws are mounted on swingable pivots 41 are provided around the door 14. Before the tank 2 is tilted upwardly, these fastening devices 40 are loosened by the operator and swung away from the door around the pivots 41 to release the door 14.

Figure 5:
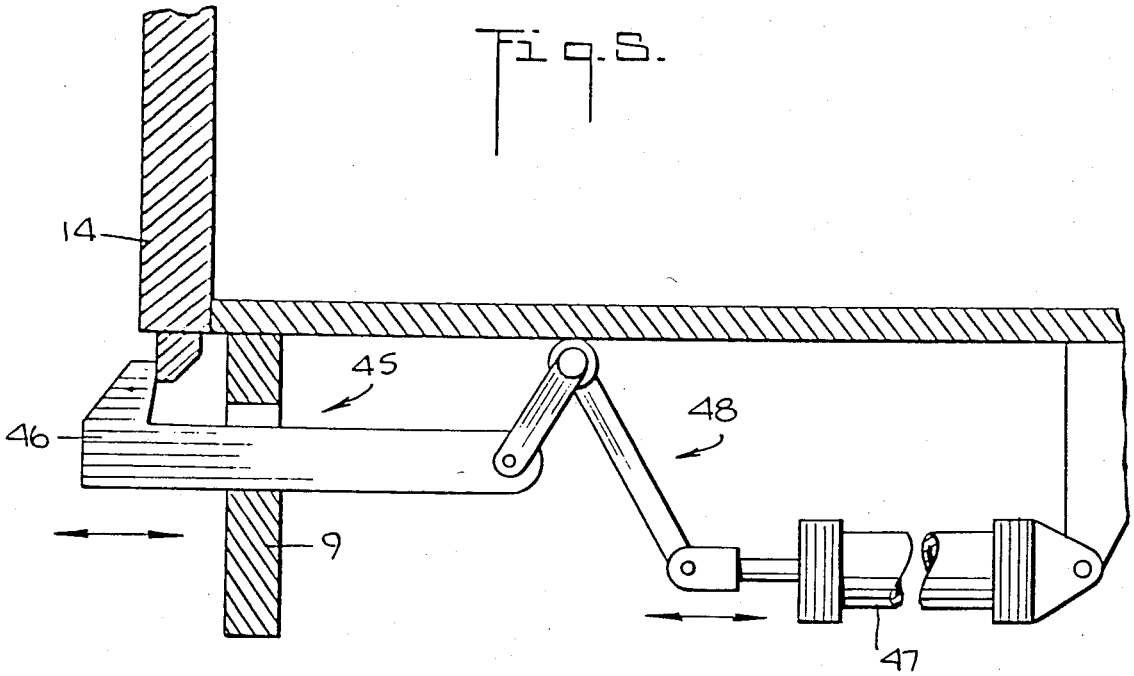
FIG. 5 is a side view of the rear door latch-release mechanism.
Figure 6:
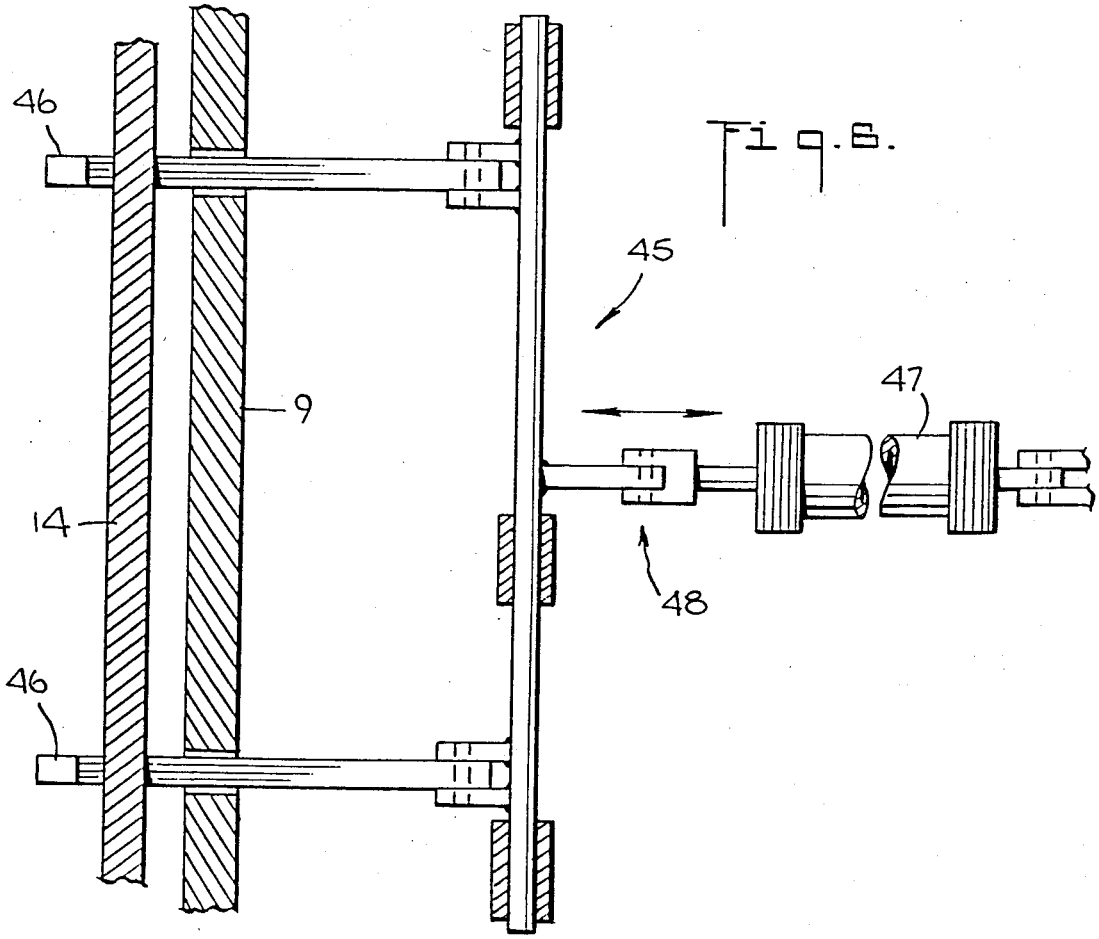
FIG. 6 is a top view thereof.

However, to prevent the rear door 14 from opening until the tank is in its fully upwardly tilted position, a safety latch mechanism 47 (FIGS. 5 and 6) is provided beneath the rear door 14. This latch mechanism 45 comprises latch arms 46 which extend through rear frame element 9 to hold the rear door 14 in place. The latch arms 46 are connected to a control unit operated by an hydraulic cylinder 47 through linkage system 48. Under normal conditions, the latch arms 46 are in their forward positions to hold the door 14 tightly closed. After the fastening devices 40 have been loosened and the settling tank 2 has been lifted, the hydraulic motor 47 is activated to move the latch arms 46 away from the door 14 thereby permitting the door 14 to swing open around pivot 15. Hence, the rear door 14 will remain tightly closed until after the settling tank is lifted.

Figure 9:
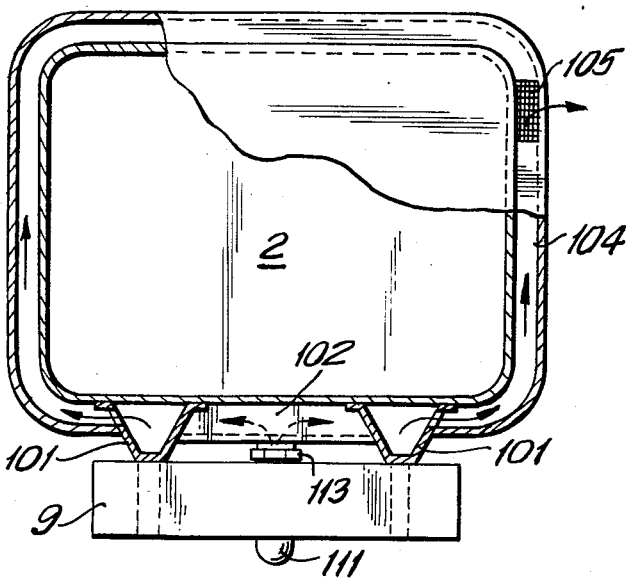
FIG. 9 is a sectional view taken along line 9—9 of FIG. 7.
Figure 10:
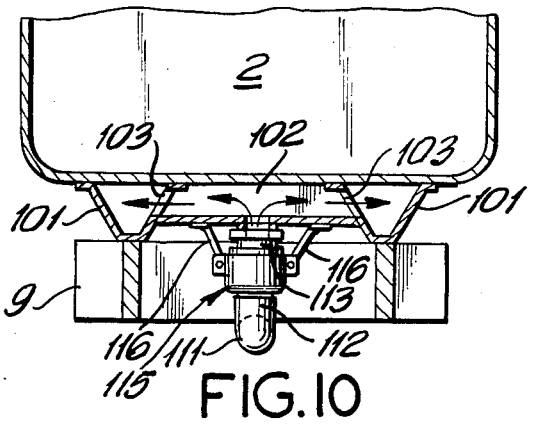
FIG. 10 is a sectional view taken along line 10—10 of FIG. 7.

Referring more particularly to FIGS. 7 through 11 which show the tank heating mechanism of the present invention, exhaust from the truck engine (not shown) under the front cab 3 of the eductor truck 1 is normally directed from the exhaust pipe 100 to an exhaust tower 110. The underside of the tank 2 is provided with a pair of longitudinally extending hot gas channels 101 which are preferably connected together by a transverse hot gas channel 102 which communicates with longitudinal gas channels 101 through openings 103 (FIG. 10). The longitudinal hot gas channels 101 are connected to and communicate with an outer gas channel 104 which surrounds the tank 2 at its rear and which has a pair of filtered exhaust openings 105 on each side (only one of which is shown in FIG. 9).

Figures 7, 8:
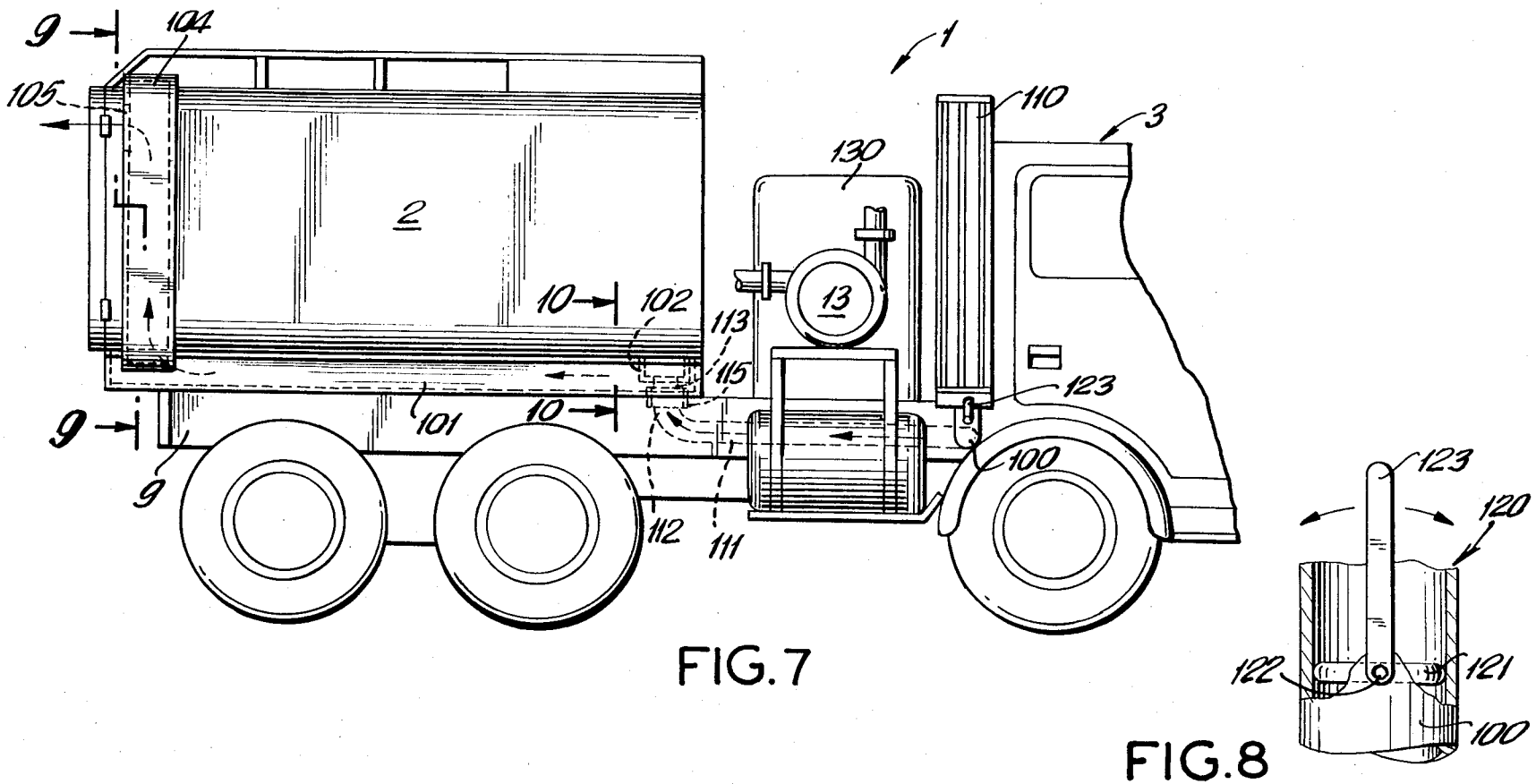
FIG. 7 is a side elevational view of an eductor truck showing the improved tank-heating mechanism of the present invention.
FIG. 8 is a detailed view showing a hot gas diverter valve.

The longitudinal gas channels 101 beneath the tank 2 and, preferably, the transverse channel 102, are connected to the engine exhaust by a rearward extension 111 of the exhaust pipe 100 which extends beneath the tank 2, as shown in broken lines in FIG. 7. The rearward extension 111 has an upstanding neck portion 112 which is adapted to communicate with and receive a downwardly extending throat 113 which is in communication with hot gas channels 101 and 102. As shown in the drawings, the rearward extension 111 extends along the center of the tank 2 and the throat 113 is positioned in the center of the transverse channel 102. However, it will be understood that the position of the rearward extension 111 as well as the position of the throat 113 may be changed without departing from the present invention. It will be further understood that, if desired, transverse gas channel 102 may be eliminated with the longitudinal channels 101 communicating through a rear outer channel 104.

Figure 11:
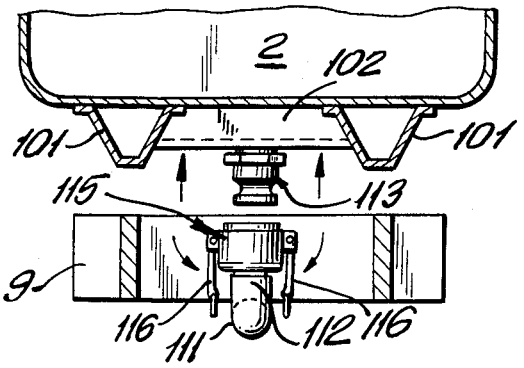
FIG. 11 is a sectional view similar to FIG. 10 showing the tank unhooked from the heating gas source.

The upstanding neck portion 112 is attached to the throat 113 by a connect-disconnect link assembly 115 as shown in FIGS. 10 and 11. In the particular embodiment shown in the drawing, the connect-disconnect link assembly 115 has locking ears 116 which lock the throat 113 and neck 112 together and unlock them in order to permit the tank 2 to be raised. However, it will be understood that other connect-disconnect type of links may be used, such as spring connecting link, as well as any other connection, which may be well known in the trade, without departing from the invention.

A diverter assembly 120 (FIG. 8) may also be provided in order to divert the hot gases from the main exhaust tower 110 to the rearward exhaust extension 111. The diverter assembly 120 comprises a damper 121 pivotally mounted on exhaust pipe 100 and movable around pin 122 by a manual handle 123 from a position closing the connection to the exhaust tower 110 thereby opening the connection to the rearward extension 111 and vice-versa.

With this structure, it will be seen that hot gases may be diverted by diverter assembly 120 directly from the exhaust system to the hot gas channels 101, 102 and 104. The hot gases are circulated along and around the tank 2 to heat it and are exhausted from the rear openings 104. Thus, the tank is maintained warm enough to prevent its contents from freezing. The diverter assembly 120 is used to connect and disconnect the gas channels 101 to and from the truck exhaust and the lock-unlock link assembly 115 is used to connect and disconnect the extension 111 to and from the throat 113 when the tank is to be raised.

While the invention has been described as using hot exhaust gases from the truck exhaust system, it will be understood that the hot gases used may come from the auxiliary motor 130 rather than the truck motor.

Figure 12:
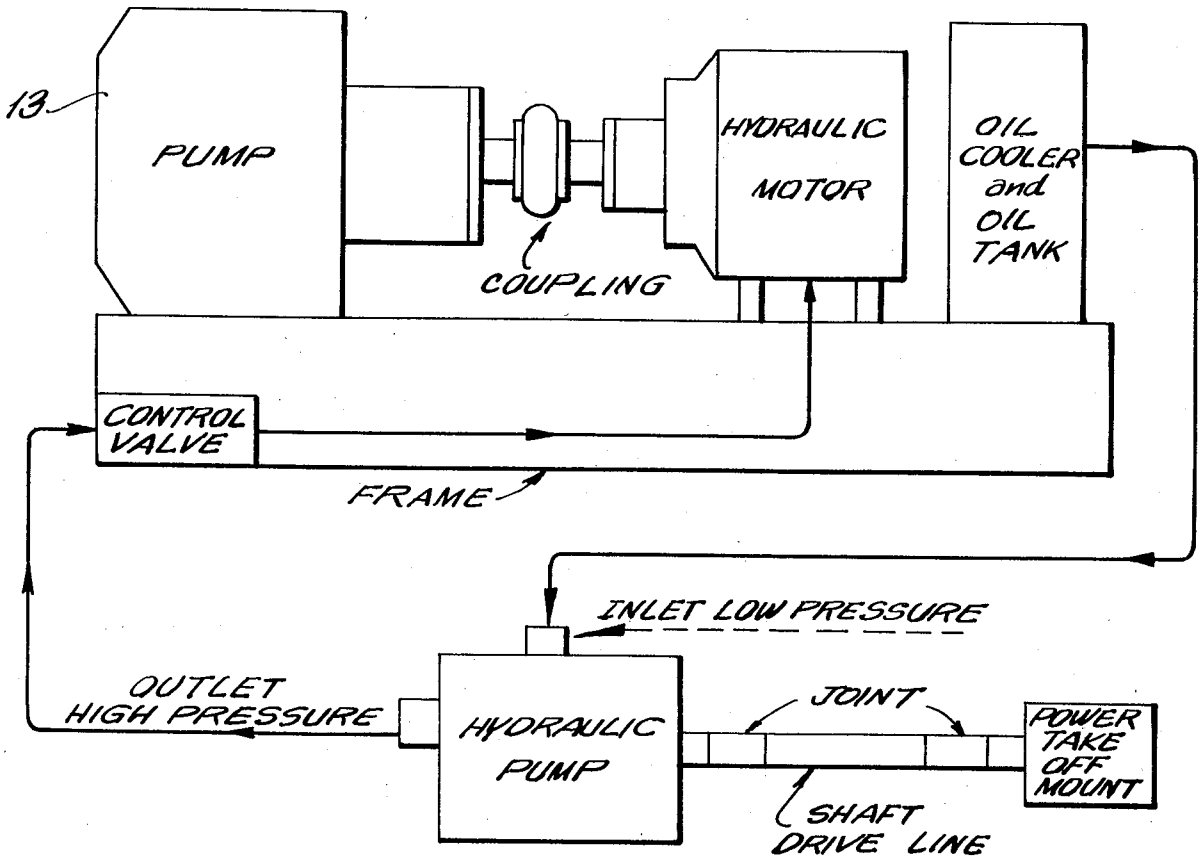
FIG. 12 is a diagrammatic view showing the manner of operating the eduction processes of the eductor truck from the transmission of the eductor truck.

As shown in the drawings, FIGS. 1 to 11, the power for controlling the educting functions of the eductor truck is obtained from the pump 13 operated by auxiliary motor 130. As shown schematically in FIG. 12, power to operate the eduction functions may be obtained from the truck transmission (not shown) in order to reduce noises. The Power Take Off is mounted on the truck transmission and is connected to an Hydraulic Pump mounted under the chassis of the truck by a shaft drive line. Control means in cab 3 may be used to engage and disengage Power Take Off from the Hydraulic Pump. Hydraulic oil from an oil cooler and oil tank is pumped to the inlet low pressure side of the hydraulic pump. The high pressure side outlet is connected to a control valve which in turn is connected to an hydraulic motor. The hydraulic motor is connected to and operates a Gorman Rupp Pump 13 and the oil may then be valved back to the oil tank. As an alternate, the pump 13 may also be mounted directly to the truck motor. In either case, auxiliary engine noise is eliminated and the operation is fully automatic.

It will thus be seen that the present invention provides an improved eductor truck which has means for preventing the rear door from swinging open and means to hold the rear door closed until it is to be opened as well as means to permit storage to tools, etc. without interfering with the lifting operation and is provided with safety features for holding the truck in its raised position as well as improved means for remotely operating the eduction units.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. An eductor truck comprising a frame, a tiltable settling tank mounted on said frame, said settling tank having an eductor unit thereon, gas-directing means operatively associated with said settling tank for passing a hot gas along the settling tank; said hot gas comprising the exhaust from the said eductor truck, said gas being directed by conduit means along said settling tank, and a connect-disconnect link connecting the exhaust conduit means to said gas-directing means.

2. An eductor truck as claimed in claim 1 wherein said conduit means comprises an exhaust extension from the truck exhaust pipe.

3. An eductor truck as claimed in claim 2 wherein said hot gas is directed to a channel adjacent the settling tank.

4. An eductor truck as claimed in claim 3 wherein said exhaust pipe extension is in communication with said channel.

5. An eductor truck as claimed in claim 4 wherein means are provided to exhaust said hot gas from said channel.

6. An eductor truck as claimed in claim 5 wherein said hot gas is directed to a circumventing channel substantially surrounding the settling tank which is in communication with the exhaust extension.

7. An eductor truck as claimed in claim 6 wherein a pair of channels are provided beneath said settling tank.

8. An eductor truck as claimed in claim 7 wherein said pair of channels are in communication with said exhaust pipe extension and said circumventing conduit.

9. An eductor truck as claimed in claim 8 wherein a divertor mechanism is adapted to divert exhaust from the truck exhaust system to said exhaust pipe extension.

10. An eductor truck as claimed in claim 9 wherein said divertor is manually operable.

11. An eductor truck as claimed in claim 8 wherein said channels are in communication with each other beneath said truck by a cross-channel.

12. An eductor truck as claimed in claim 8 wherein a connect-disconnect link connects the exhaust pipe extension to said channel.

13. An eductor truck as claimed in claim 12 wherein said link is a spring linkage.

14. An eductor truck as claimed in claim 12 wherein said connect-disconnect link is connected to said cross-channel.

* * * * *